US007828348B2

(12) United States Patent
Bolbocianu et al.

(10) Patent No.: US 7,828,348 B2
(45) Date of Patent: Nov. 9, 2010

(54) LATCH STRIKER WITH INTEGRAL STRIKER BAR

(75) Inventors: Liviu Bolbocianu, North York (CA); Vladimir Beserminji, North York (CA)

(73) Assignee: Magna Closures Inc., Newmarket (CA)

( * ) Notice: Subject to any disclaimer, the term of this patent is extended or adjusted under 35 U.S.C. 154(b) by 130 days.

(21) Appl. No.: 11/718,841

(22) PCT Filed: Nov. 18, 2005

(86) PCT No.: PCT/CA2005/001748

§ 371 (c)(1),
(2), (4) Date: May 8, 2007

(87) PCT Pub. No.: WO2006/053431

PCT Pub. Date: May 26, 2006

(65) Prior Publication Data

US 2008/0093866 A1 Apr. 24, 2008

(51) Int. Cl.
*E05B 15/02* (2006.01)
*B21B 1/46* (2006.01)

(52) U.S. Cl. ..... 292/340; 29/527.1; 29/527.2; 29/558

(58) Field of Classification Search ..... 292/340; 29/558, 527.1, 527.2
See application file for complete search history.

(56) References Cited

U.S. PATENT DOCUMENTS 1,334,575 A * 3/1920 White ..... 292/113
1,936,921 A * 11/1933 Strid ..... 292/340
2,211,963 A * 8/1940 Strid ..... 292/99
3,467,428 A * 9/1969 Constable ..... 292/340
3,985,381 A 10/1976 Kobayashi
4,451,071 A * 5/1984 Striese et al. ..... 292/341.18
5,209,531 A * 5/1993 Thau ..... 292/216
5,263,752 A 11/1993 Phail-Fausey et al.
5,494,208 A 2/1996 Granger
5,695,200 A * 12/1997 Diez et al. ..... 277/593
5,927,774 A 7/1999 Granger
6,000,737 A * 12/1999 Yiu ..... 292/340
6,092,810 A * 7/2000 Plunkett ..... 277/593
6,095,577 A 8/2000 Nolzen
6,209,883 B1 * 4/2001 Kashmerick et al. ..... 277/593
D442,907 S 5/2001 Santelman
6,672,634 B2 1/2004 Burton
6,692,046 B2 * 2/2004 Paskonis ..... 292/340

(Continued)

FOREIGN PATENT DOCUMENTS

WO WO95/32347 A1 11/1995

*Primary Examiner*—Carlos Lugo
(74) *Attorney, Agent, or Firm*—Alex Porat; Magna International Inc.

(57) ABSTRACT

A single piece striker for a latch formed from stock, comprising a mounting plate with an integral striker bar. The striker bar extends out from the mounting plate via a neck portion. The engagement area of the striker bar has a greater diameter than the thickness of the mounting plate. The striker is formed using a progressive die. The striker bar is formed by compressing a portion of the stock to a greater thickness than the rest of the striker. Compressing a portion of the stock also provides a rounded engagement area across the length of the strike bar. Compression occurs over a series of dies that provide a progressively rounder shape. Locator channels within the dies help retain the striker bar during compression.

9 Claims, 6 Drawing Sheets

U.S. PATENT DOCUMENTS

| | | | | |
|---|---|---|---|---|
| 7,097,219 | B2 * | 8/2006 | Paskonis | 292/340 |
| 7,399,012 | B2 * | 7/2008 | Yoshimura | 292/340 |
| 2003/0000064 | A1 | 1/2003 | Sawajiri | |
| 2003/0090114 | A1 | 5/2003 | Kang | |
| 2004/0119299 | A1 | 6/2004 | Paskonis | |

* cited by examiner

LATCH STRIKER WITH INTEGRAL STRIKER BAR

FIELD OF THE INVENTION

The invention generally relates to latch assemblies. More specifically, the invention relates to a latch striker for an automotive vehicle.

BACKGROUND OF THE INVENTION

Currently, U-bolt style latch strikers are typically formed from two components, a base and a striker bar. The base is formed using a stamped, sheet metal component that can be mounted to a vehicle body. The striker bar is mounted to the base and extends out from the base to receives a ratchet and pawl assembly located on a latch. The striker bar must be sufficiently thick enough to withstand the stress of both conventional use and accident damage (in accordance with government safety standards). A rounded engagement surface on the striker bar is preferred, as it provides a smooth latching surface for the ratchet and pawl assembly.

The striker bar is typically formed from a wire since conventional stamping does not provide a striker bar of satisfactory thickness and roundedness across the full length and surface area of the striker bar. The wire is bent into the striker shape, and then mounted to the base, typically by hot staking. While meeting operational requirements, the conventional assembly of a latch striker can be time consuming and it can be difficult to achieve the tight tolerances required for automotive vehicles.

Attempts have been made to produce a less-expensive and more precise striker by forming the striker directly from the sheet metal base instead of attaching a wire striker. U.S. Pat. No. 6,692,046 (hereafter the '046 patent) teaches a simplified latch striker formed from welding together two symmetrical L-shaped plates. Using two formed pieces placed together, stamped sheet metal can provide the required thickness and strength for the striker bar. Cap welding around the two halves of the striker bar rounds the engagement surface and helps to reduce the seam created between the two welded L-shaped plates. While this process may be more efficient than hot-staking a separate wire striker bar, welding is still required, increasing both the costs and the weight of the striker. The '046 patent also teaches a latch striker created by bending a sheet metal component in half, negating the need to weld two plates together. However, cap-welding of the seem formed between the two halves in the region of the engagement surface is still required.

It is still desired to provide a latch striker that can be manufactured from a single piece of sheet metal, does not require additional welding or assembly, achieves a high level of precision, and reduces the weight of the striker while maintaining the required thickness, strength and roundedness of the striker bar.

SUMMARY OF THE INVENTION

The invention obviates or mitigate at least one of the disadvantages of the prior art. According to a first aspect of the invention, there is provided a single piece striker for a latch. The striker includes a mounting plate, operable to be mounted to a vehicle body and align the striker relative to a latch. An integral striker bar having a unitary body extends out from the mounting plate via a neck portion of the mounting plate, the striker bar providing an engagement area operable to receive a ratchet and pawl assembly on the latch. The engagement area of the striker bar has a diameter greater than the thickness of the stock.

According to another aspect of the invention, there is provided a method for manufacturing a single-piece striker for a latch from a stock of a first thickness using a progressive die. The striker comprises a mounting plate, and a striker bar extending out from the mounting plate via a neck portion. The striker bar has a diameter greater than the first thickness. The method comprises stamping at least one mounting area in a portion of the stock, stamping at least one neck portion in another portion of the stock, and punching a void out of the neck portion, thereby defining a striker bar portion in the stock. The striker bar portion is compressed to a second thickness greater than the first thickness, thereby forming the striker bar. The stock is then cut, thereby forming the striker from the cut portion of stock.

DETAILED DESCRIPTION OF THE DRAWINGS

Figure 1:
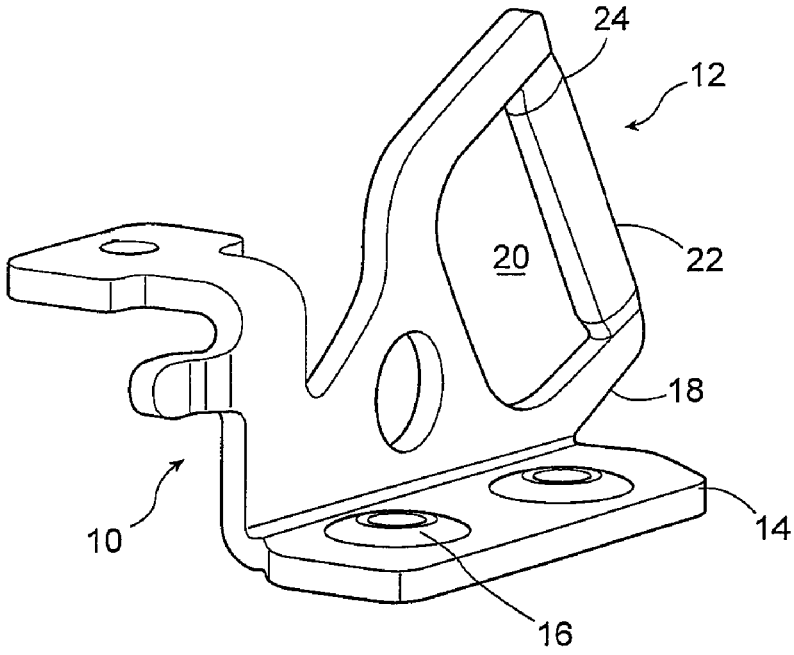
FIG. 1 is a perspective view of a striker formed in accordance with the invention.
Figure 2:
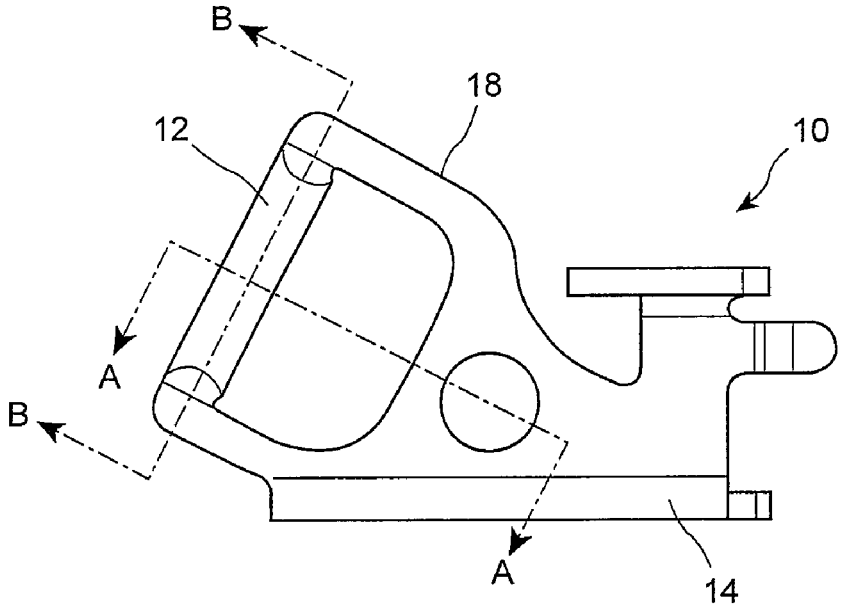
FIG. 2 is a plan view of the striker shown in FIG. 1.
Figure 3A:
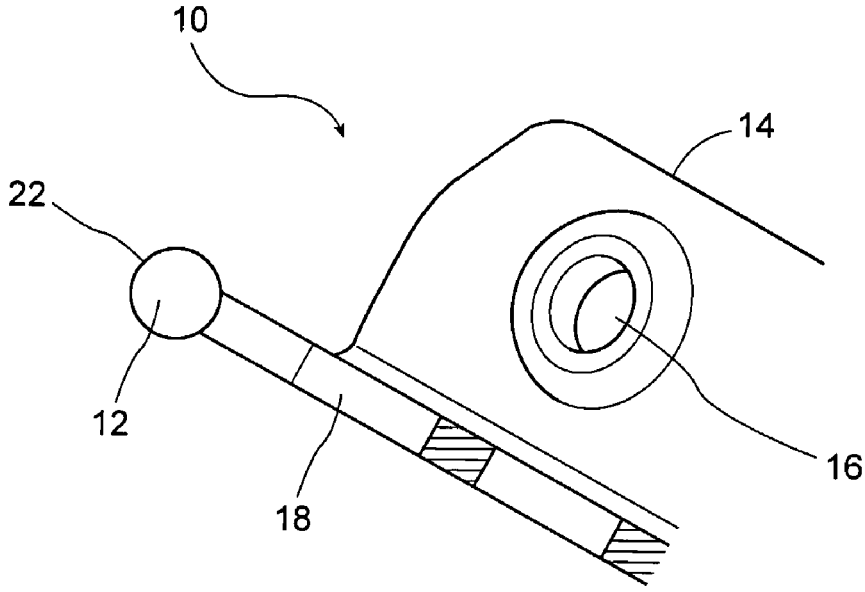
Figure 3B:
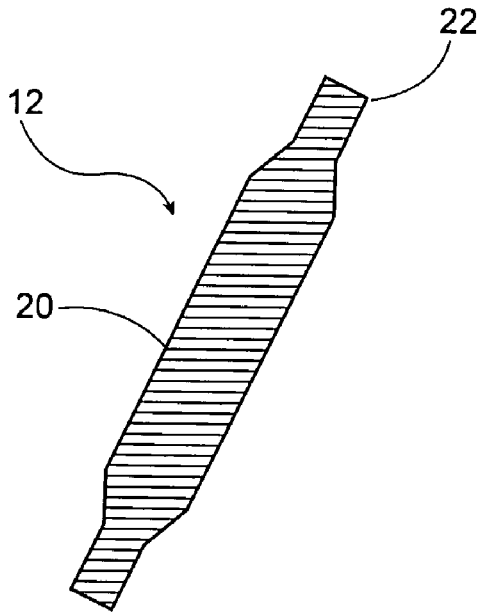
Figure 4:
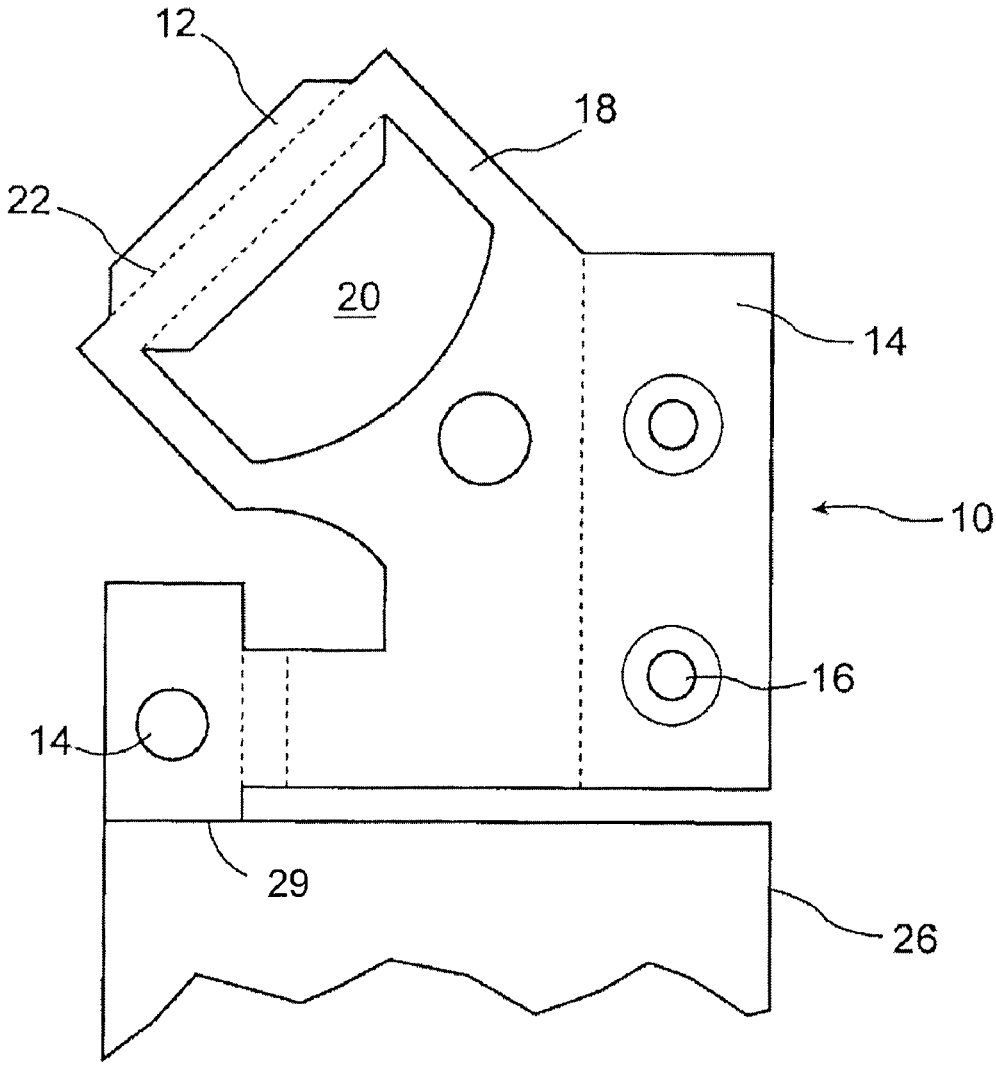
Figure 5A:
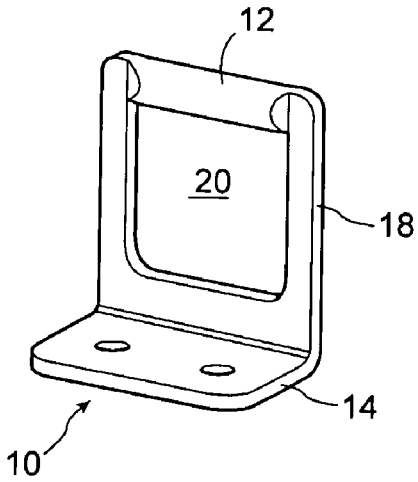
Figure 5B:
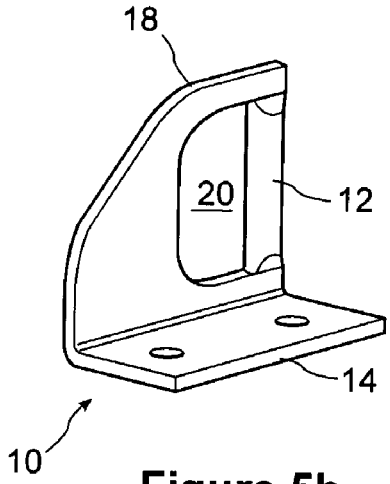
Figure 5C:
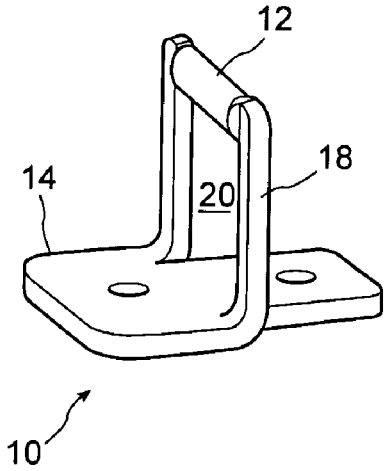
Figure 5D:
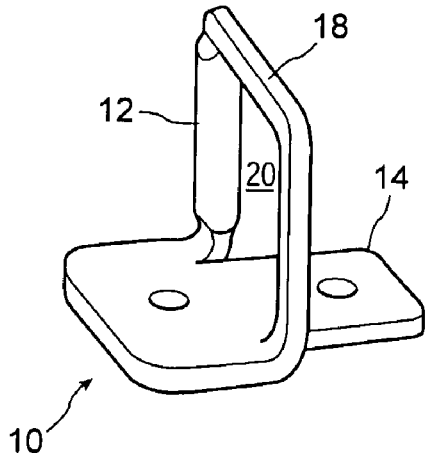
Figure 6:
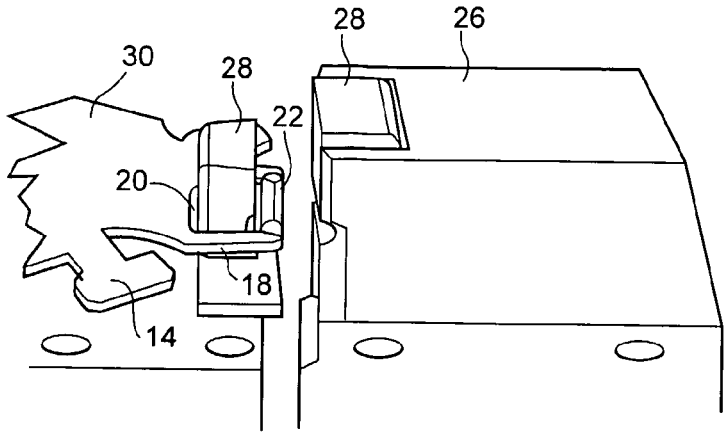
Figures 7A, 7B, 7C, 7D, 7E:
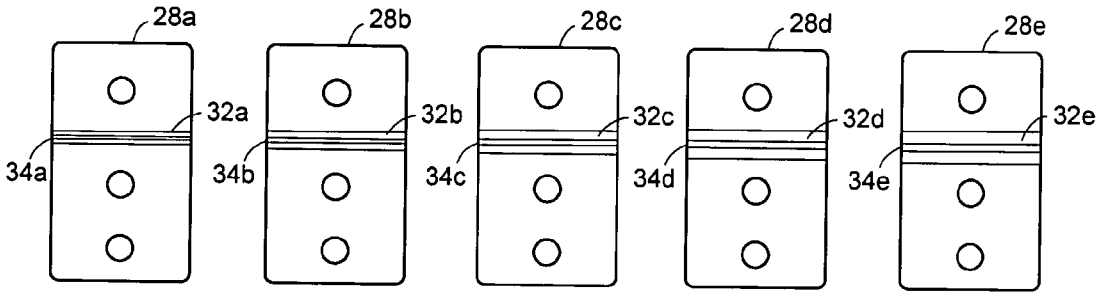
Figure 8:
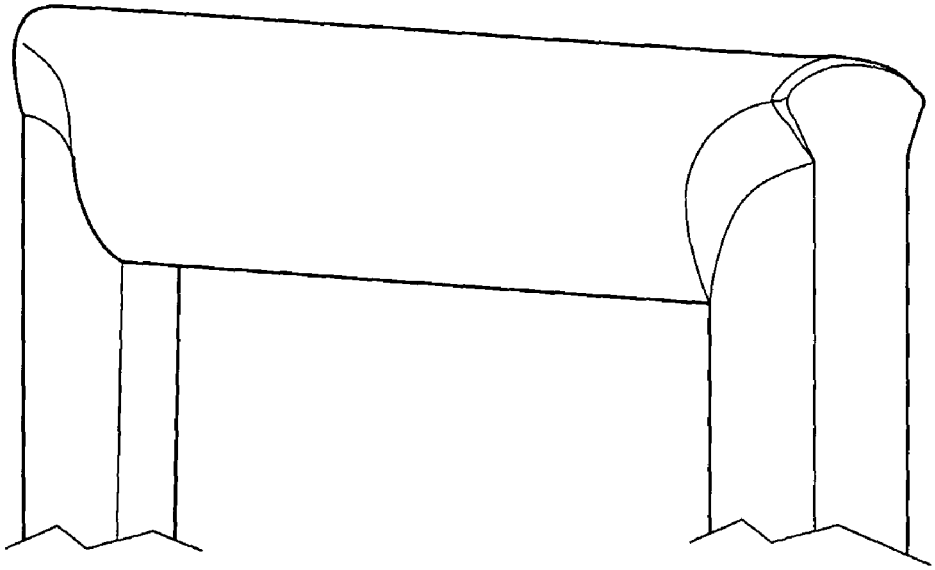
Figure 8:
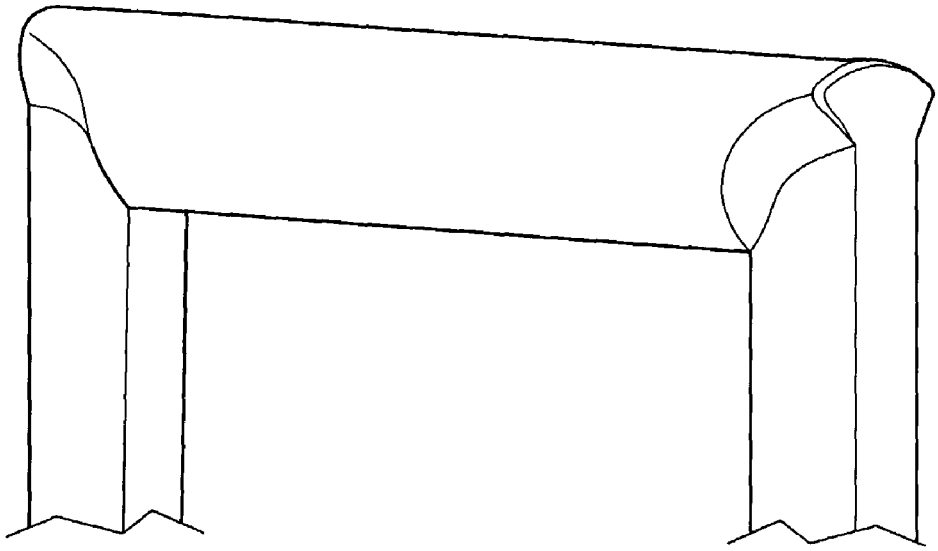

FIG. 3*a* is a cross section view of the striker shown in FIG. 2, taken along the lines A-A;

FIG. 3*b* is a cross section view of the striker shown in FIG. 2, taken along the lines B-B;

FIG. 4 is a partial plan view of a portion stock used to form the striker shown in FIGS. 1 and 2;

FIG. 5*a* to 5*d* are perspective views of other embodiments of strikers formed in accordance with the invention;

FIG. 6 is a perspective view of the striker shown in FIGS. 1 to 4 being formed at a simplified die station;

FIGS. 7*a* to 7*e* are plan views of dies used to form an engagement area on the striker shown in FIG. 6; and FIG. 8 is a detail view of a transition area of a striker bar according to another embodiment.

DETAILED DESCRIPTION OF THE INVENTION

Referring now to FIGS. 1 and 2, a latch striker in accordance with a preferred aspect of the invention is shown generally at 10. Latch striker 10 is operable to be engaged by a conventional latch (not shown) mounted to a vehicle door or lift gate. Typically, the latch includes a ratchet and pawl assembly that is partially exposed through an opening (typically referred to as a "fishmouth") in the latch body. As the automobile door, gate, hatch or trunk is closed, a striker bar 12 of the latch striker, as further described below, enters the fish mouth, actuating the pawl, and is thereby engaged by a ratchet on the latch.

Latch striker 10 is formed from a durable material such a cased-hardened, high strength steel like SAE 4130. Other steel alloys and materials will occur to those of skill in the art. The steel is provided as coil or bar stock and in the current embodiment, is 3 mm thick. Other thicknesses will occur to those of skill in the art.

Latch striker 10 includes a mounting plate 14 having a plurality of mounting holes 16. Mounting plate 14 can be flat, multi-tiered, or contoured to better fit the portion of the vehicle that they are mounted to. Mounting holes 16 are operable to receive fasteners such as screws, bolts or rivets to secure latch striker 10 to the vehicle body. Striker bar 12 is displaced away from mounting areas 12 by a neck portion 18. Neck portion 18 further aligns striker bar 12 with the latch's fishmouth (not shown) when the door, hatch or gate closes. Preferably, neck portion 18 is perpendicular to at least a portion of mounting plate 14. A void 20 in neck portion 18 allows the latch's ratchet and pawl (not shown) to fully envelope striker bar 16. Other void 20's may be provided in latch striker 10 in order to reduce the weight and amount of material used in the striker.

Preferably, striker bar 12 is straight along its longitudinal axis. Striker bar 12 provides a unitary body including a rounded engagement area 22 to properly receive the latch. As can be clearly seen in FIGS. 3*a* and 3*b*, striker bar 12 is rounded and is thicker in diameter than the connecting sheet metal in neck portion 18. Engagement area 22 of striker bar 12 has a diameter greater than the thickness of the connecting sheet metal in order to properly withstand the impact of the ratchet, and to resist deformation. In the current embodiment, engagement area 22 of striker bar 12 has a diameter of 6 mm. The cross-sectional shape of engagement area 22 is not particularly limited, and can be round, oval, or round or oval-flattened on one or two or four sides. Other cross-section shapes of engagement area 22 will occur to those of skill in the art.

A sloped area 24 is provided on each side of engagement area 22 to provide a smooth transition in thickness and shape from neck portion 18 to engagement area 22. The sloped area may be along the engagement area or towards the neck portion, as illustrated in FIG. 8. The shape of sloped area 24 is not particularly limited and can be a regular tapered shape, a chamfered or rounded blended shape, shaped with a stepped level, or shaped with a shoulder. Other shapes of sloped area 24 will occur to those of skill in the art.

In the current embodiment, latch striker 10 is formed using a progressive die (not shown) using a number of stations to form the latch striker. FIG. 6 shows a simplified station 26 mounting a compression die 28 (used to form engagement area 22). Coil or bar stock 30 is run through a number of stations 26 to form each latch striker 10. In the current embodiment, coil stock is used, and excess material is cut away from stock 30. At different station 26 of the die run. portions of the stock 30 are progressively bent (as indicated by the dashed bend lines) to form mounting plate 14 and neck portion 18. Also during the die run, mounting holes 16 is punched out of the stock. Void 20 is preferably formed via wire-cutting to reducing undesired flash. While wire-cutting is the preferred technique to create void 20, those of skill in the art will recognize that punching could be also used. After void 20 is cut, a flat striker bar 12 runs between the two ends of neck portion 18. At this stage of forming, striker bar 12 runs the length of the stock, is 3 mm thick (the same as the starting stock), and is approx 9 mm wide.

At subsequent stations 26 in the progressive die, the flat striker bar 12 is compressed width-wise between two compression dies 28, thereby rounding the striker bar and forming engagement area 22 and sloped areas 24 (as indicated by the dotted lines). It will be apparent that the die located within void 20 will typically be narrower than the void on the opposite side of the striker bar. In the illustrated embodiment, striker bar 12 is rounded over five die stations 26 with dies 28*a* to 28*e*. Each compression die 28 features a concave forming area 32 and a pair of locating channels 34 to catch the partially-formed striker bar. Over the sequence of rounding stations 26*a* to 26*e*, the locating channels 34*a* to 34*e* become shallower and the curvature of concave forming area 32*a* to 32*e* increases. In this fashion, striker bar 16 is rounded in profile and shaped to the desired diameter of 6 mm.

Finally, the stock is cut along line 29 and a fully-formed latch striker 10 falls into a parts bin. By using cold-forming techniques on a progressive die to produce the striker bar, a higher level of consistency is achieved over prior art methods. If desired, latch striker 10 can be electro-plated after forming.

It will be apparent to those of skill in the art that the order of steps taken using the progressive die can vary, in order to optimize the manufacture of latch striker 10. It will also be apparent to those of skill in the art that the thickness of the stock, and the final diameter of engagement area 22 can vary, depending on the materials used and the requirements of the vehicle. Referring now to FIGS. 5*a-d*, other embodiments of the invention are shown. As can be seen from the figures, rounded engagement area 22 can be located in different positions, alignments, and have different axes of engagement relative to mounting plate 14, depending on the requirements of the vehicle. Alternatively, if a less-rounded striker engagement area 22 is acceptable, then compression dies 28 can be used with shallower concave forming areas 32, resulting in a blockier striker bar 12 that is still thicker than the surrounding bar stock.

Those skilled in the art will appreciate that a variety of modifications may be made to the methods and embodiments described above without departing from the spirit or scope of the invention.

What is claimed is:

1. A method for manufacturing at least one single-piece striker for a latch from a stock of a first thickness using a progressive die, each striker comprising a mounting plate, a striker bar, and a neck portion connecting the striker bar to the mounting plate, the method for each striker comprising the steps of:

punching or cutting a selected shape out of the stock;

forming at least one mounting plate in a respective portion of the selected shape;

creating a void out of another portion of the selected shape by one of punching or cutting techniques, thereby defining a striker bar portion with a width greater than the first thickness and defining the neck portion adjacent the striker bar;

compressing and rounding the striker bar portion to create the striker bar having an engagement area that is thicker than the first thickness;

cutting the selected shape from the stock; and bending the selected shape along the at least one mounting portion to form the striker.

2. The method of claim 1, wherein compressing the striker bar portion of the stock further provides a rounded engagement surface for the striker bar.

3. The method of claim 2, wherein compressing the striker bar portion of the stock is done using a series of dies having a progressively rounder shaper.

4. The method of claim 3 wherein at least some of the dies in the series of dies includes locator channels to retain the striker bar during compression.

5. The method of claim 4, wherein the depth of the locator channels decreases progressively over the series of dies that include locator channels.

6. The method of claim 5, further comprising creating at least one mounting hole out of the mounting area using at least one of punching or cutting techniques.

7. The method of claim 6, wherein the stock is a coil stock.

8. The method of claim 7, wherein the coil stock is SAE 410 steel.

9. The method of claim 8, wherein the first thickness is one of equal to and less than 3 mm, and the second thickness is at least 6 mm.

* * * * *